US007159553B2

(12) United States Patent
Krapp et al.

(10) Patent No.: US 7,159,553 B2
(45) Date of Patent: Jan. 9, 2007

(54) VALVE TRAIN FOR AN INTERNAL COMBUSTION ENGINE

(75) Inventors: Roland Krapp, Wattendorf (DE); Peter Sailer, Erlangen (DE)

(73) Assignee: Schaeffler KG (DE)

( * ) Notice: Subject to any disclaimer, the term of this patent is extended or adjusted under 35 U.S.C. 154(b) by 0 days.

(21) Appl. No.: 11/313,983

(22) Filed: Dec. 21, 2005

(65) Prior Publication Data

US 2006/0207528 A1 Sep. 21, 2006

(30) Foreign Application Priority Data

Dec. 22, 2004 (DE) ..... 10 2004 061 680

(51) Int. Cl.
*F01L 1/14* (2006.01)

(52) U.S. Cl. ..... 123/90.5; 123/90.16; 123/90.48

(58) Field of Classification Search ..... 123/90.5, 123/90.16, 90.48, 90.55, 90.61
See application file for complete search history.

(56) References Cited

U.S. PATENT DOCUMENTS 6,513,472 B1 * 2/2003 Speil et al. ..... 123/90.16

FOREIGN PATENT DOCUMENTS

| | | |
|---|---|---|
| DE | 101 42 329 | 3/2003 |
| DE | 102 04 672 | 8/2003 |
| DE | 103 60 293 | 10/2004 |

* cited by examiner

*Primary Examiner*—Thomas Denion
*Assistant Examiner*—Zelalem Eshete
(74) *Attorney, Agent, or Firm*—Charles A. Muserlian

(57) ABSTRACT

The invention provides a valve train for an internal combustion engine, comprising an elongate anti-rotation bridge (16) acting as a retention device and a mounting aid and comprising receptions (18) for valve lash adjusters arranged spaced behind one another. A valve adjuster configured as a roller tappet (17) is arranged in each reception (18) while being directed through a tappet roller (22) toward a cam of a camshaft. The roller tappet (17) is retained for longitudinal displacement in the reception (18) and is secured against rotation through flat key surfaces arranged on its outer peripheral surface that bear against corresponding inner surfaces of the anti-rotation bridge (16). An opening (28) of the anti-rotation bridge (16) for allowing a passage of a tappet pushrod that is supported on an end of the roller tappet (17) is associated to each reception (18), and a support surface (27) limiting each reception (18) is configured in the anti-rotation bridge (16) for supporting that end of each roller tappet (17) that faces away from the tappet roller.

2 Claims, 5 Drawing Sheets

Fig. 1
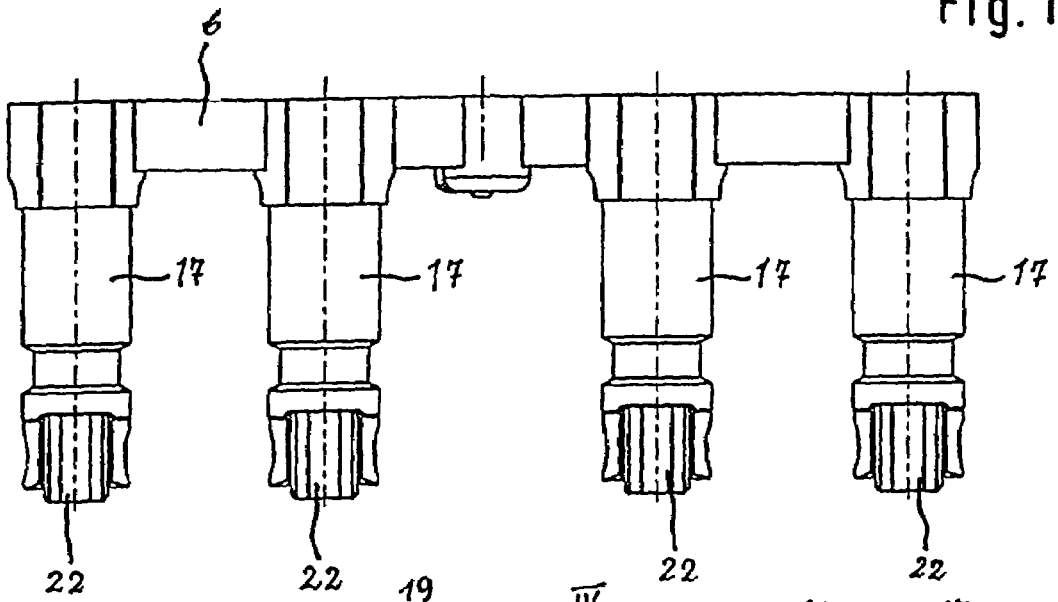
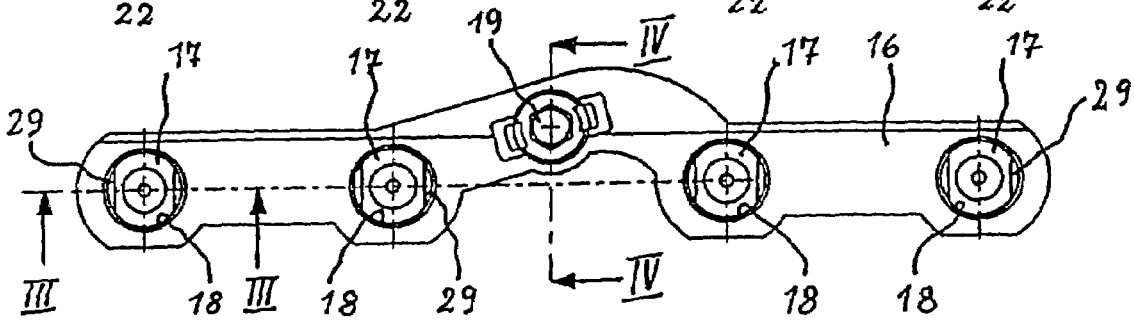
Fig. 2
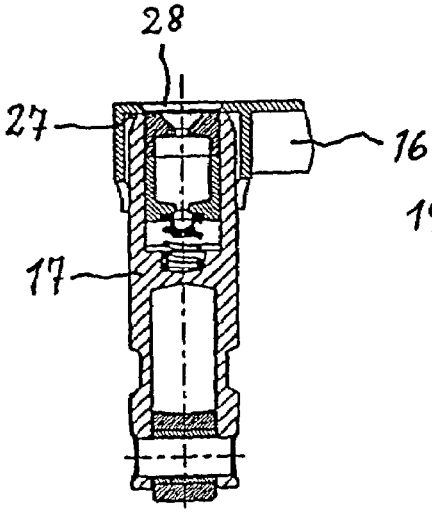
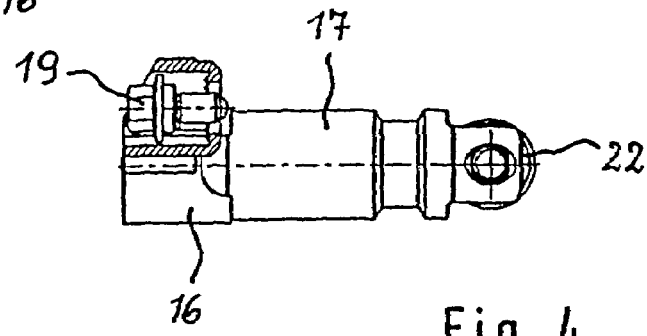
Fig. 4
Fig. 3

VALVE TRAIN FOR AN INTERNAL COMBUSTION ENGINE

FIELD OF THE INVENTION

The invention concerns a valve train for an internal combustion engine, said valve train comprising an elongate anti-rotation bridge acting as a retention device and a mounting aid and comprising receptions for valve lash adjusters arranged spaced behind one another, a valve adjuster configured as a roller tappet being arranged in each reception while being directed through a tappet roller toward a cam of a camshaft, said roller tappet being retained for longitudinal displacement in the reception and secured against rotation through flat key surfaces arranged on an outer peripheral surface of the roller tappet that bear against corresponding inner surfaces of the anti-rotation bridge, and an opening of the anti-rotation bridge for allowing a passage of a tappet pushrod that is supported on an end of the roller tappet being associated to each reception.

BACKGROUND OF THE INVENTION

It is known to deliver hydraulic valve lash adjusters configured as roller tappets that have already been installed in anti-rotation bridges, together with these, to engine manufacturing plants and to mount them there on internal combustion engines. For instance, anti-rotation bridges made to U.S. Pat. No. 5,088,455 are bought as manufactured components and fitted with several roller tappets and a screw for fixing the anti-rotation bridge on an engine housing, and are then supplied as a complete assembly to the engine manufacturer. This, however, necessitates a double transportation locking device for the hydraulic components in each roller tappet. This is achieved firstly through the chucking force acting between the key surfaces of the roller tappet and the corresponding surfaces of the bridge and secondly through a locking ring installed in the roller tappet. This results in an expensive construction because cost-intensive work steps are required for the fabrication and an additional component has to be arranged in the roller tappet.

A valve train of the aforesaid type is known from the document DE 102 12 522 A1. As shown in FIGS. 6 and 7 of this document, the roller tappet that is inserted into an anti-rotation bridge comprises an outer section that is retained for axial displacement in the bridge and an inner section that is retained for axial displacement in a bore of the outer section. The inner section is formed by a piston that is divided along a transverse plane into a lower piston part and an upper piston part. To assure that the inner section does not come loose during mounting and transportation but remains in the outer section, an additional component in the form of a locking ring that holds the upper piston part fast is inserted into an inner circumferential groove of the outer section.

OBJECTS OF THE INVENTION

It is an object of the invention to provide a simple assembled unit made safe for transportation and comprising an anti-rotation bridge with inserted roller tappets for the valve train of an internal combustion engine.

This assembled unit must have only a few components that still have to be mounted and must be easy to attach to the engine, so that engine manufacturing becomes more economic.

These and other objects and advantages of the invention will become obvious from the following detailed description.

SUMMARY OF THE INVENTION

The invention achieves the above objects by the fact that a support surface limiting each reception is configured in the anti-rotation bridge for supporting that end of each roller tappet that faces away from the tappet roller. In this way, the anti-rotation bridge, in addition to securing the roller tappets against rotation, takes over the function of the transportation safety device for their hydraulic components. The roller tappet together with its components is retained as a whole by the support surface in the anti-rotation bridge so that an additional locking ring is no longer required. This simplifies the structure of the roller tappet because a groove for receiving the locking ring in the roller tappet can also be omitted.

The roller tappet supported through its end on the support surface is formed by an outer cylindrical section and a piston part of an axially displaceable inner cylindrical section inserted into the outer cylindrical section. The piston part can be supported on two tabs of the anti-rotation bridge that prolong the support surface in a plane of the support surface. In this case, a re-setting spring of the roller tappet pushes the inner section, and thus the piston part into a transportation position, with a maximum possible design height of the inner section. In this position, the spring is no longer pre-stressed. If, now, a tappet pushrod connecting the roller tappet to the gas exchange valve is inserted into the valve train on the engine, the danger exists that the valve that is open in this position, may collide during the operation of the engine with the engine piston situated in the engine cylinder. Therefore, during assembly, the tappet pushrod together with piston part and the entire inner section must be pushed further into the outer section of the roller tappet, which is done against the action of the re-setting spring and the hydraulic medium in the high pressure chamber of the roller tappet. This requires a large amount of energy because the hydraulic fluid can escape out of the high pressure chamber only through the leak gaps, so that the assembly time is considerably increased.

This can be countered by the fact that the piston part is supported on two axial projections or lugs of the anti-rotation bridge that project out of the plane of the support surface toward the roller tappet. These lugs guarantee the required pre-adjustment of the piston part in the roller tappet for the subsequent reliable functioning of the valve train already at the mounting of the roller tappet in the anti-rotation bridge prior to transportation of the assembled unit. Thus, in this case, the re-setting spring is pre-stressed already before transportation takes place. The lugs are configured and arranged in the region of each opening of the anti-rotation bridge for the passage of the tappet pushrod such that no freedom-of-movement problems can occur. Thus, for example, the required pivoting ability of the tappet pushrod is assured despite the lugs. In place of a circular opening that is partially covered at two diametrically opposite points by the two lugs, it is also possible, for example, to provide an opening with an oval or an elliptical shape.

Another means for achieving the required pre-adjustment of the roller tappet is to additionally attach a clip in the region of each opening on the anti-rotation bridge. Different materials are suitable for the fabrication of the anti-rotation bridge which can be made, for instance, as a sheet metal part or a plastic part.

Some examples of embodiment of the invention are represented in the drawing and will be described more closely below.

BRIEF DESCRIPTION OF THE DRAWINGS

FIG. 1 is a side view of an anti-rotation bridge of the invention comprising four inserted roller tappets;

FIG. 2 is a top view of the anti-rotation bridge of FIG. 1;

FIG. 3 shows an axial section through the roller tappet inserted into the left-hand end region of the anti-rotation bridge, along line III—III of FIG. 2;

FIG. 4 shows a cross-section through the anti-rotation bridge, along line IV—IV of FIG. 2;

DETAILED DESCRIPTION OF THE DRAWING

Figure 9:
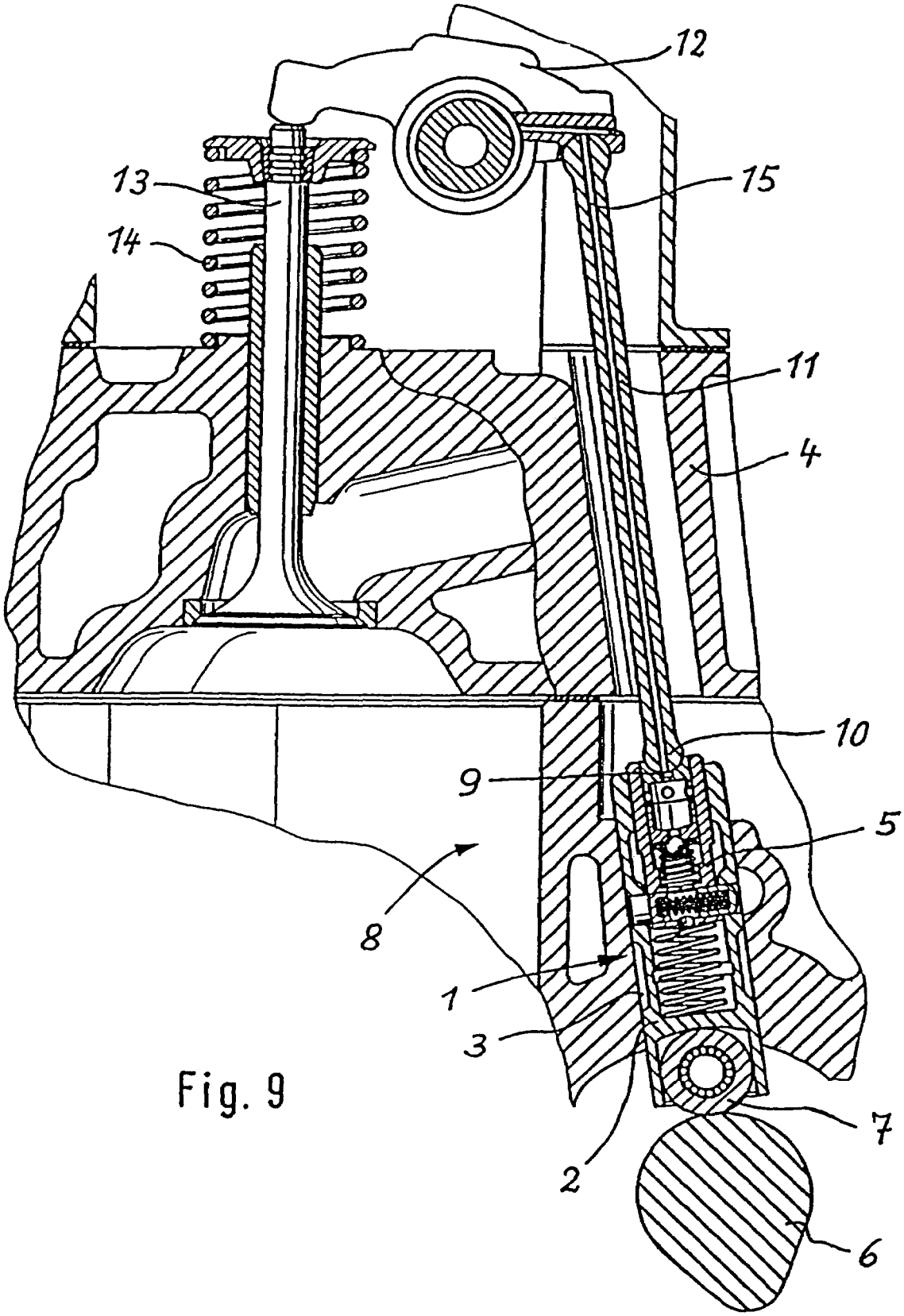
FIG. 9 shows an axial section through a prior art valve train comprising a roller tappet but no anti-rotation bridge.

A prior art hydraulic valve lash adjuster configured in the form of a roller tappet 1 as disclosed in the document DE 198 44 202 A1 is illustrated in FIG. 9. This roller tappet 1 comprises an outer cylindrical section 2 that is arranged for axial displacement in a cylindrical reception 3 of an internal combustion engine 4. The roller tappet 1 further comprises an inner cylindrical section 5. This is arranged in a cylindrical recess of the outer section 2 and acts as a pressure piston that is axially displaceable relative to the outer section 2. This outer section 2 is axially supported through one end on a cam 6 of a camshaft. A rolling bearing-mounted roller 7 is arranged for rotation on the roller tappet 1 in this end region. The outer peripheral surface of the roller 7 is the contacting surface for a direct contact of the roller tappet 1 with the cam 6.

The roller tappet 1 is a part of a valve train 8 of the internal combustion engine 4. The inner section 5 of the roller tappet 1 comprises on its end turned away from the cam 6, a cup-shaped support surface 9 for an axial end 10 of a tappet pushrod 11 of the valve train 8. Through the tappet pushrod 11 and a rocker arm 12, the roller tappet 1 is connected to a gas exchange valve 13 of the internal combustion engine 4, so that, at rotation of the camshaft that carries the cam 6, the gas exchange valve 13 opens periodically at every cam lift and is closed again through the action of its valve spring 14. A supply passage 15 for supplying the roller tappet 1 with hydraulic medium is arranged in the tappet pushrod 11.

Figure 7:
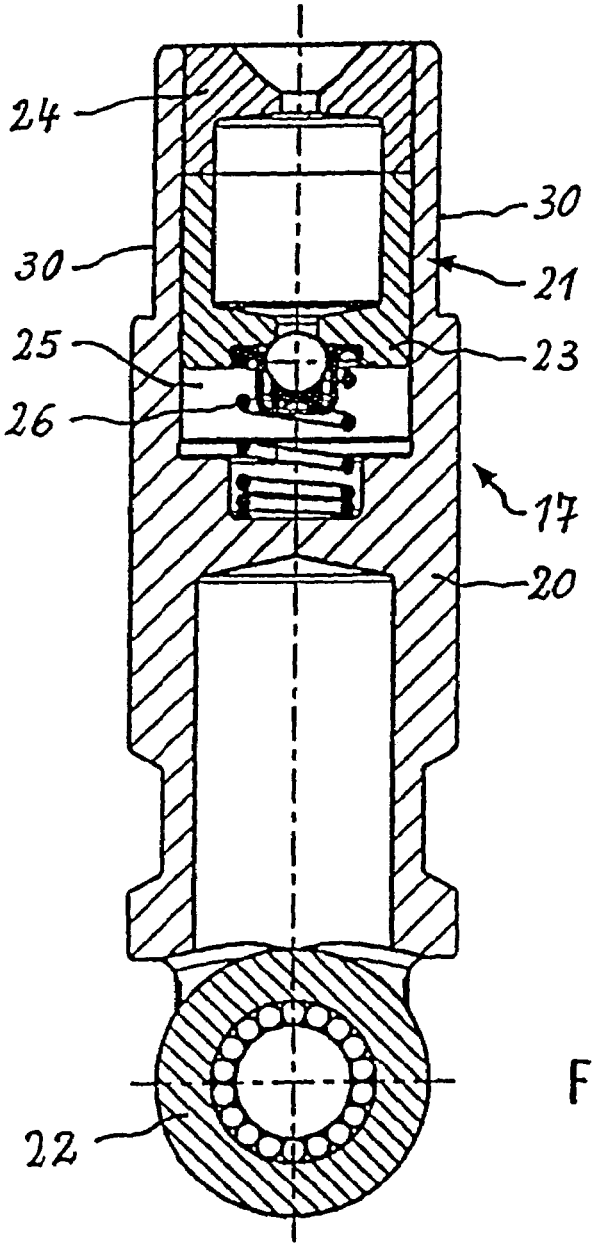
FIG. 7 shows an axial section through the roller tappet turned through 90°, along line VII—VII of FIG. 5
Figure 8:
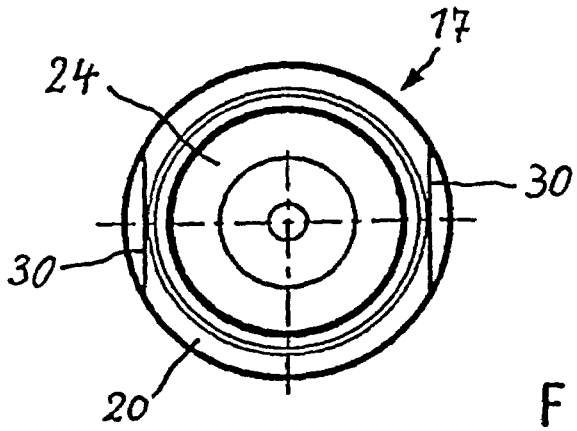
FIG. 8 is a top view of the roller tappet of FIG. 7.

A valve train of the invention, illustrated in FIGS. 1 to 5, comprising an anti-rotation bridge 16 and roller tappets 17, one of which is represented in FIGS. 7 and 8, comprises four receptions 18 arranged spaced one behind the other in a straight line. A reception region for a screw 19 for fixing the bridge 16 on the internal combustion engine is situated at the center of the bridge. A roller tappet 17 is inserted with its upper end into each reception 18 and retained through force-locking.

Each roller tappet 17 comprises an outer cylindrical section 20 and an inner cylindrical section 21. A tappet roller 22 is mounted for rotation on the lower end of the outer section 20. The outer peripheral surface of the tappet roller 22 serves as a contacting surface for the cam of a camshaft. At its upper end, the outer section 20 comprises a bore into which the inner section 21 is fitted. The inner section 21 comprises a piston that is divided along a transverse plane into a lower piston part 23 and an upper piston part 24. The lower piston part 23 adjoins a high pressure chamber 25 of the roller tappet 17 for the hydraulic medium and is supported there axially on a re-setting spring 26.

Figure 5:
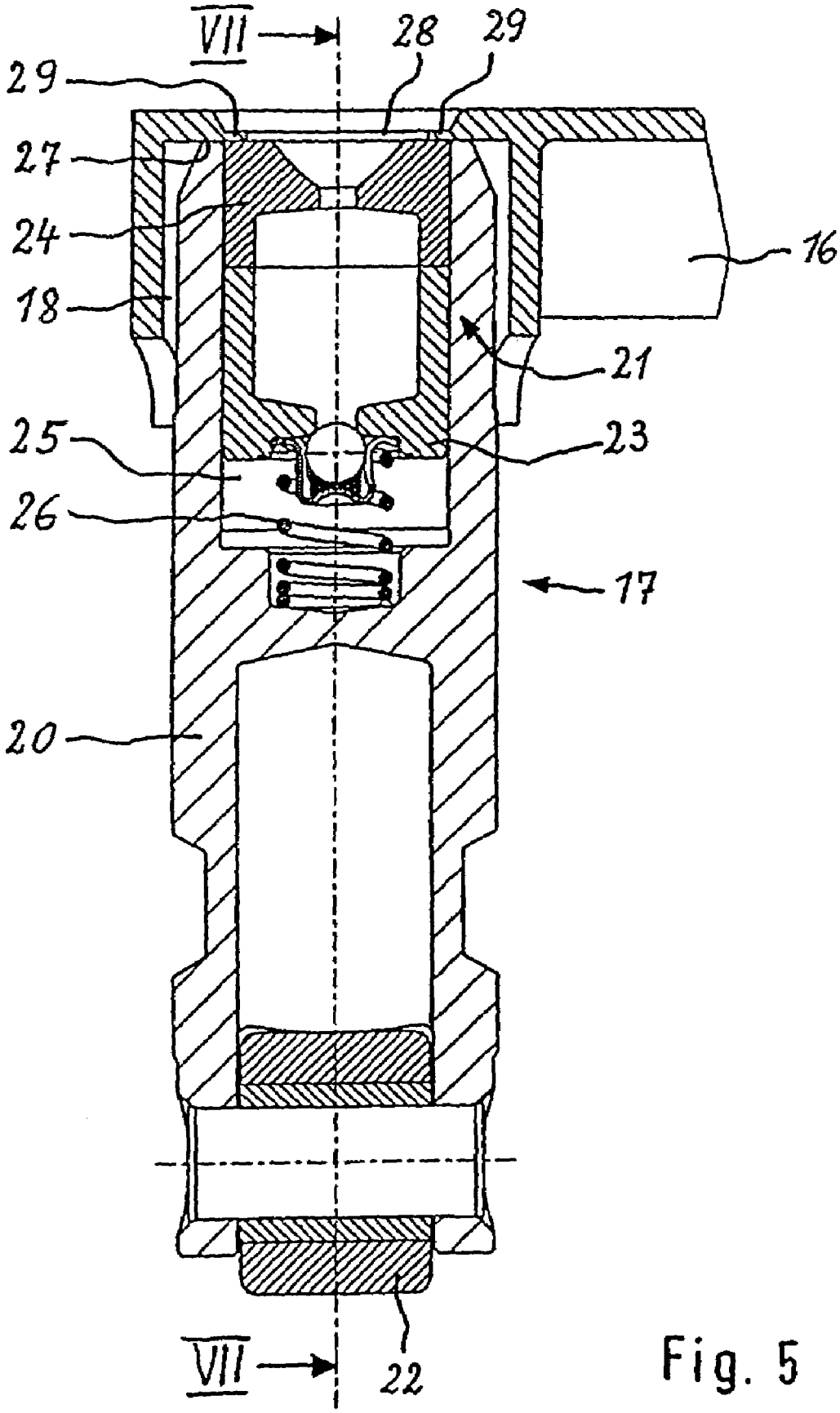
FIG. 5 is an enlarged representation of the end region of the bridge comprising the roller tappet of FIG. 3.

The upper end faces of the upper piston part 24 and of the outer section 20 are situated, as shown in FIG. 5, in one plane. In this position, the re-setting spring 26 is not pre-stressed. According to the invention, the anti-rotation bridge 16 comprises a support surface 27 for these end faces of the roller tappet 17. This support surface 27 is situated in the region of an opening 28 of the anti-rotation bridge 16 that is provided for receiving the end of a tappet pushrod that is supported on the upper piston part 24. Two tabs 29 of the anti-rotation bridge 16 that are situated diametrically opposite each other on the opening 28 and reduce the clear width of the otherwise circular opening 28, are associated to the support surface 27. These tabs 29 form the support surface for the upper piston part 24 of the roller tappet 17. The hydraulic components of the roller tappet are thus retained axially in the anti-rotation bridge 16.

For securing the roller tappet 17 against rotation, the outer section 20 of the roller tappet 17 comprises on its length region that is inserted into the anti-rotation bridge 16, two flat, parallel key surfaces 30 that are configured diametrically opposite each other on the outer peripheral surface of the outer section 20 and bear against corresponding inner surfaces of the anti-rotation bridge 16.

Figure 6:
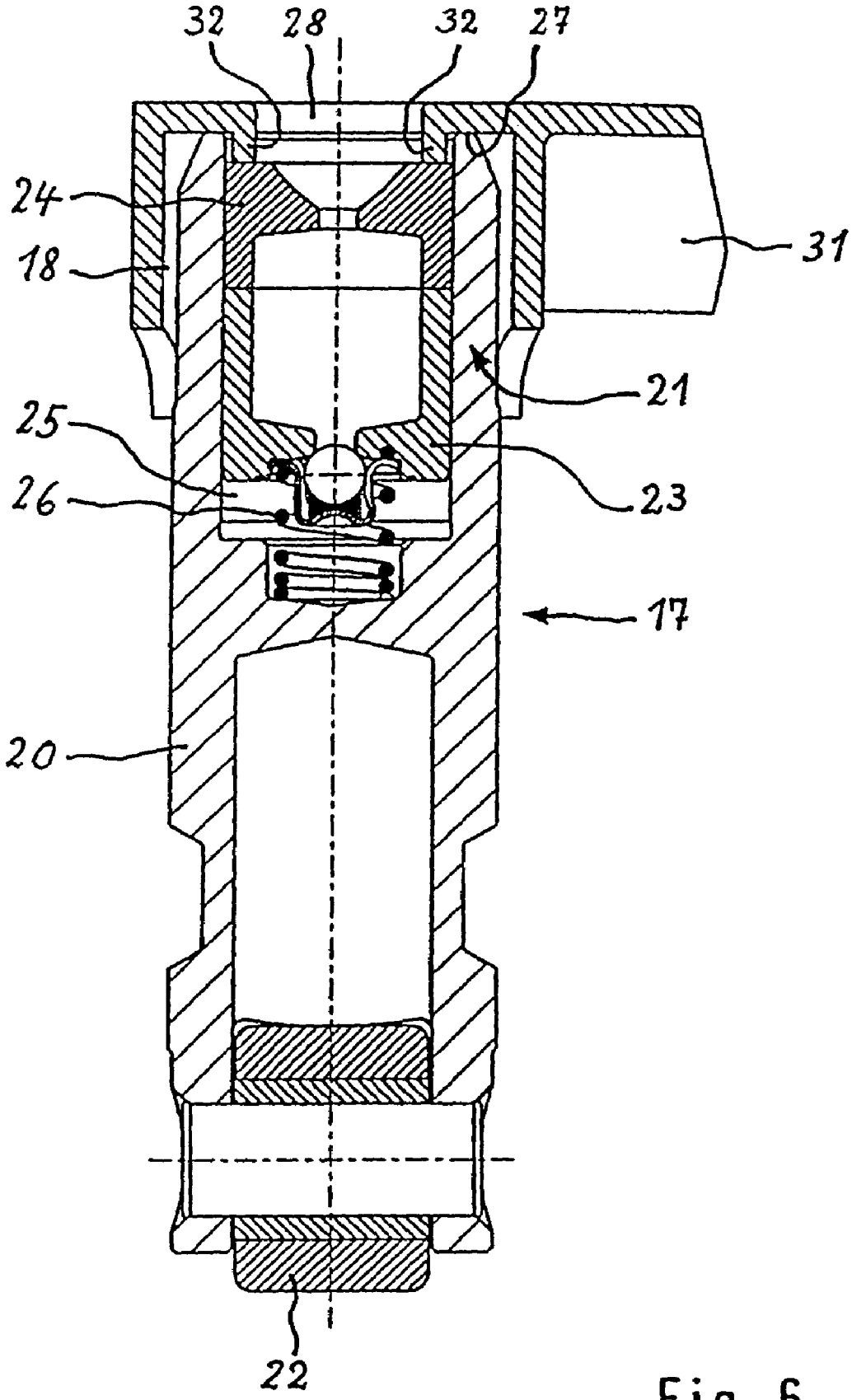
FIG. 6 shows a modified embodiment of the anti-rotation bridge of FIG. 5 comprising the roller tappet.

The anti-rotation bridge 31 of the invention illustrated in FIG. 6 has basically the same configuration as the bridge 16 described above, but it is modified to the effect that two projections or lugs 32 extending from the opening 28 axially toward the roller tappet 17 are associated to the support surface 27 in each reception 18 for the roller tappets 17. Thus, in this embodiment, only the outer section 20 of the roller tappet is supported on the support surface 27, while the upper piston part 24 of the inner section 21 is supported on the projecting lugs 32.

In this position, the inner section 21, made up of the lower piston part 23 and the upper piston part 24, is pressed further into the high pressure chamber 25 than in the position shown in FIG. 5, and the re-setting spring 26 is pre-stressed for mounting the anti-rotation bridge 31 on the internal combustion engine.

The invention claimed is:

1. A valve train for an internal combustion engine, said valve train comprising an elongate anti-rotation bridge acting as a retention device and a mounting aid and comprising receptions for valve lash adjusters arranged spaced behind one another, a valve adjuster configured as a roller tappet being arranged in each reception while being directed through a tappet roller toward a cam of a camshaft, said roller tappet being retained for longitudinal displacement in the reception and secured against rotation through flat key surfaces arranged on an outer peripheral surface of the roller tappet that bear against corresponding corresponding inner surfaces of the anti-rotation bridge, and an opening of the anti-rotation bridge for allowing a passage of a tappet pushrod that is supported on an end of the roller tappet being associated to each reception, wherein a support surface limiting each reception is configured in the anti-rotation bridge for supporting that end of each roller tappet that faces away from the tappet roller and is formed by an outer cylindrical section and a piston part of an axially displaceable inner cylindrical section inserted into the outer cylindrical section, wherein the piston part is supported on two tabs of the anti-rotation bridge that prolong the support surface in a plane of the support-surface.

2. A valve train for an internal combustion engine, said valve train comprising an elongate anti-rotation bridge acting as a retention device and a mounting aid and comprising receptions for valve lash adjusters arranged spaced behind one another, a valve adjuster configured as a roller tappet being arranged in each reception while being directed through a tappet roller toward a cam of a camshaft, said roller tappet being retained for longitudinal displacement in the reception and secured against rotation through flat key surfaces arranged on an outer peripheral surface of the roller tappet that bear against corresponding corresponding inner surfaces of the anti-rotation bridge, and an opening of the anti-rotation bridge for allowing a passage of a tappet pushrod that is supported on an end of the roller tappet being associated to each reception, wherein a support surface limiting each reception is configured in the anti-rotation bridge for supporting that end of each roller tappet that faces away from the tappet roller and the roller tappet is formed by an outer cylindrical section and a piston part of an axially displaceable inner cylindrical section inserted into the outer cylindrical section, wherein the piston part is supported on two axial projections, typically lugs of the anti-rotation bridge that project out a plane of the support surface toward the roller tappet.

* * * * *